US011183139B2

(12) United States Patent
Kim et al.

(10) Patent No.: US 11,183,139 B2
(45) Date of Patent: Nov. 23, 2021

(54) DISPLAY DEVICE AND DRIVING METHOD THEREOF

(71) Applicant: SAMSUNG DISPLAY CO., LTD., Yongin-si (KR)

(72) Inventors: Won Tae Kim, Yongin-si (KR); Ji Hye Kim, Yongin-si (KR); Jae Hyeon Jeon, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/899,779

(22) Filed: Jun. 12, 2020

(65) Prior Publication Data

US 2021/0027739 A1 Jan. 28, 2021

(30) Foreign Application Priority Data

Jul. 24, 2019 (KR) ..... 10-2019-0089864

(51) Int. Cl.
*G09G 5/00* (2006.01)

(52) U.S. Cl.
CPC ..... *G09G 5/00* (2013.01); *G09G 2330/022* (2013.01); *G09G 2380/02* (2013.01)

(58) Field of Classification Search
CPC .... G09G 5/00; G09G 5/008; G09G 2330/022; G09G 2330/028; G09G 2330/12; G09G 2380/02; G09G 2370/08; G09G 2320/0686; G09G 2310/0291
See application file for complete search history.

(56) References Cited

U.S. PATENT DOCUMENTS

2008/0024480 A1* 1/2008 Jee ..... G06F 1/3265 345/212
2015/0316976 A1* 11/2015 Toyotaka ..... G06F 1/1641 361/679.27
2018/0367736 A1* 12/2018 Lombardi ..... G06F 1/1652
2019/0339808 A1* 11/2019 Park ..... G06F 3/0412

FOREIGN PATENT DOCUMENTS

KR 1020080010789 A 1/2008

* cited by examiner

*Primary Examiner* — Brent D Castiaux
(74) *Attorney, Agent, or Firm* — Cantor Colburn LLP

(57) ABSTRACT

A display device includes: a first pixel connected to a first scan line and a data line; a second pixel connected to a second scan line and the data line; and a data driver connected to the data line. The data driver includes: a data voltage generator which applies a data voltage corresponding to a grayscale value of the first pixel to the data line when a scan signal of a turn-on level is applied to the first scan line; and an off voltage generator which applies an off voltage corresponding to a black grayscale value to the data line when a scan signal of a turn-on level is applied to the second scan line, in a first mode.

18 Claims, 11 Drawing Sheets

DISPLAY DEVICE AND DRIVING METHOD THEREOF

This application claims priority to Korean Patent Application No. 10-2019-0089864, filed on Jul. 24, 2019, and all the benefits accruing therefrom under 35 U.S.C. § 119, the content of which in its entirety is herein incorporated by reference.

BACKGROUND

1. Field

The disclosure relates to a display device and a driving method thereof.

2. Description of the Related Art

With development of an information technology, importance of a display device, which is a connection medium between a user and information, is highlighted. Accordingly, use of the display device, such as a liquid crystal display device, an organic light emitting display device, a plasma display device, or the like is increasing.

Recently, various display device products such as a foldable display device, a rollable display device, and a stretchable display device have been developed by adopting a flexible board for the display panel.

SUMMARY

A foldable display device may display an image in the entire display area in an unfolded state and may be configured to display the image only in a partial display area in a folded state. In such a foldable display device, it is desired to reduce power consumption for the remaining display area in which the image is not displayed in the folded state.

The disclosure is to provide a display device and a driving method of the display device capable of reducing power consumption for a display area where an image is not displayed.

According to an embodiment, a display device includes: a first pixel connected to a first scan line and a data line; a second pixel connected to a second scan line and the data line; and a data driver that is connected to the data line. In such an embodiment, the data driver includes: a data voltage generator which applies a data voltage corresponding to a grayscale value of the first pixel to the data line when a scan signal of a turn-on level is applied to the first scan line; and an off voltage generator which applies an off voltage corresponding to a black grayscale value to the data line when a scan signal of a turn-on level is applied to the second scan line, in a first mode.

In an embodiment, the display device may further include a pixel unit including a first area and a second area spaced apart from each other by a folding line as a boundary, the first pixel may be located in the first area, the second pixel may be located in the second area, and the pixel unit may be folded on a basis of the folding line in the first mode.

In an embodiment, in a second mode in which the pixel unit is in an unfolded state, the data voltage generator may apply a data voltage corresponding to a grayscale value of the second pixel to the data line when a scan signal of a turn-on level is applied to the second scan line.

In an embodiment, in the second mode, the off voltage generator may not apply the off voltage to the data line when the scan signal of the turn-on level is applied to the second scan line.

In an embodiment, the data driver may further include a transceiver which sequentially provides grayscale values to the data voltage generator during an active data period, and the transceiver may generate a lock failure signal such that the off voltage is applied to the data line when a lock failure of a clock signal occurs during the active data period.

In an embodiment, the display device may further include a switch having a terminal connected to the data line and another terminal connected to an output terminal of the off voltage generator, and the switch may connect the data line to the output terminal of the off voltage generator when the lock failure signal is generated.

In an embodiment, the data voltage generator may include a buffer unit which generates the data voltage and a buffer power supplier which supplies a buffer power voltage to the buffer unit, and the buffer power supplier may stop supplying the buffer power voltage when the lock failure signal is generated.

In an embodiment, the buffer power supplier may stop supplying the buffer power voltage after a predetermined delay period when the lock failure of the clock signal occurs.

In an embodiment, the data voltage generator may apply a data voltage corresponding to the black grayscale value to the data line during the delay period.

In an embodiment, the data voltage generator may apply a data voltage corresponding to the black grayscale value to the data line when the scan signal of the turn-on level is applied to the second scan line, in the first mode.

In an embodiment, the display device may further include a timing controller which transmits a clock data signal to the data driver; and the timing controller may cause the lock failure of the clock signal by not transmitting data for maintaining the clock signal in the clock data signals.

In an embodiment, the display device may further include a timing controller which transmits a clock data signal to the data driver; and the timing controller may cause the lock failure of the clock signal by maintaining a voltage level of the clock data signal for a predetermined period.

In an embodiment, the transceiver may include a phase detector which operates during the active data period and a charge pump which determines a charge supply amount based on an output of the phase detector, and the charge pump may be electrically isolated from the phase detector when the lock failure of the clock signal occurs during the active data period.

According to another embodiment, a driving method of a display device includes: folding the display device on a basis of a folding line, where the display device includes a first area and a second area spaced apart from each other by the folding line as a boundary; when the display device is in an folded state, applying a data voltage corresponding to a grayscale value of a first pixel connected to a first scan line to a data line when a scan signal of a turn-on level is applied to the first scan line, where the first pixel is connected to the data line, and the first pixel and the first scan line are in the first area; and when the display device is in the folded state, applying an off voltage corresponding to a black grayscale value to the data line when the scan signal of the turn-on level is applied to a second scan line connected to a second pixel, where the second pixel is connected to the data line, and the second pixel and the second scan line are in the second area.

In an embodiment, the driving method may further include unfolding the display device on a basis of the folding line; when the display device is in an unfolded state, applying a data voltage corresponding to a grayscale value of the first pixel to the data line when a scan signal of a turn-on level is applied to the first scan line; and applying a data voltage corresponding to a grayscale value of the second pixel to the data line when the scan signal of the turn-on level is applied to the second scan line.

In an embodiment, when the display device is in the folded state and a lock failure of a clock signal occurs during a supply period of the scan signals of the turn-on level, the off voltage may be applied to the data line.

In an embodiment, the driving method may further include, when the lock failure of the clock signal occurs, stopping supplying a buffer power voltage for a buffer unit that generates the data voltage.

In an embodiment, when the lock failure occurs of the clock signal, supplying the buffer power voltage may be stopped after a predetermined delay period.

In an embodiment, the driving method may further include applying a data voltage corresponding to the black grayscale value to the data line during the delay period.

In an embodiment, a period in which the data voltage corresponding to the black grayscale value may be applied to the data line partially overlaps a period in which the off voltage is applied to the data line.

In embodiments of the invention, the display device and the method of driving the display device may reduce power consumption for a display area in which an image is not displayed.

BRIEF DESCRIPTION OF THE DRAWINGS

The above and other features of the invention will become more apparent by describing embodiments thereof in detail with reference to the accompanying drawings, in which.

DETAILED DESCRIPTION

The invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. The same reference numbers indicate the same components throughout the specification. In the attached figures, the thickness of layers and regions is exaggerated for clarity.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." "At least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, embodiments of the invention will be described in detail with reference to the accompanying drawings.

Figure 1:
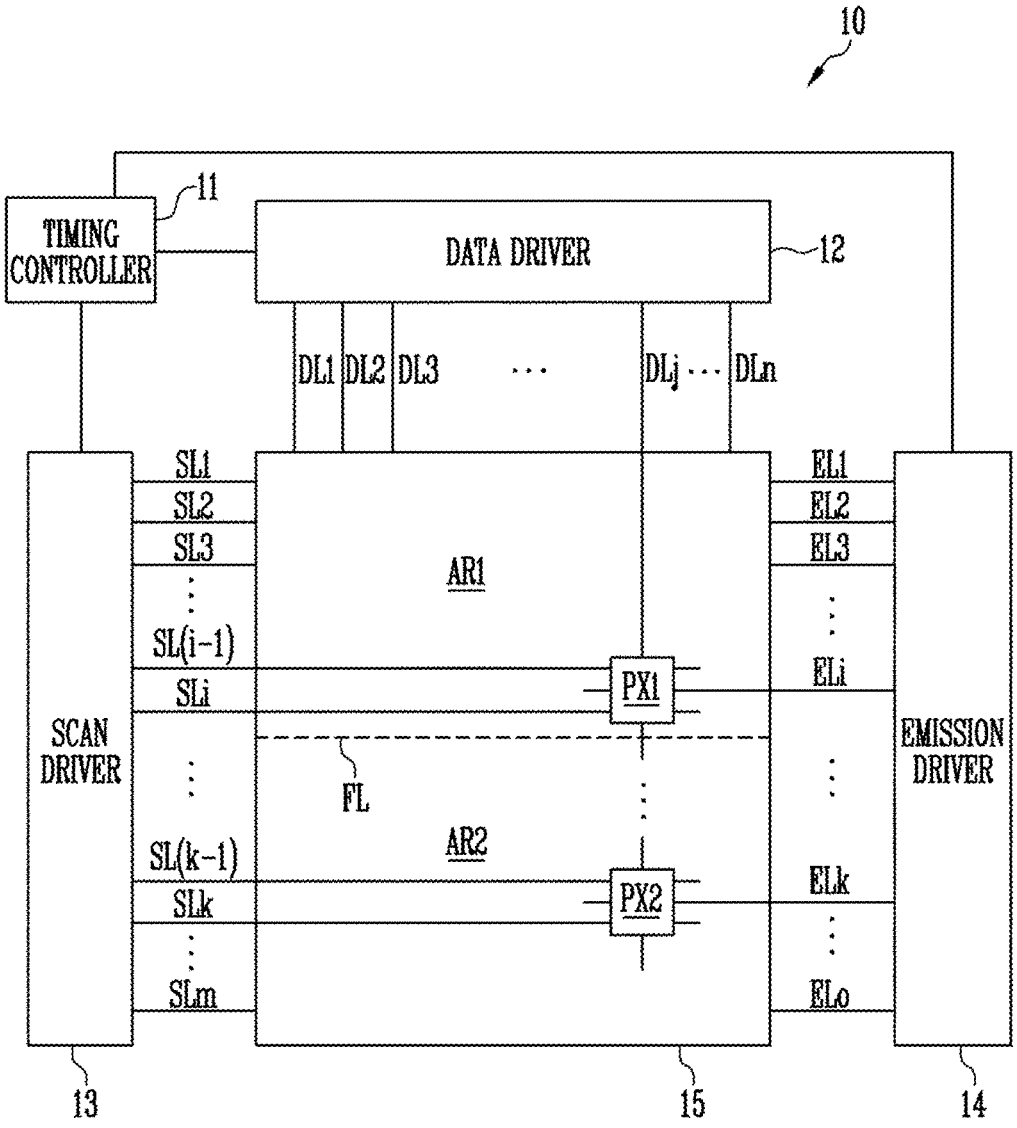
FIG. 1 is a block diagram illustrating a display device according to an embodiment of the disclosure.

FIG. 1 is a block diagram illustrating a display device according to an embodiment of the disclosure.

Referring to FIG. 1, an embodiment of a display device may include a timing controller 11, a data driver 12, a scan driver 13, an emission driver 14, and a pixel unit 15.

The timing controller 11 may receive grayscale values for each image frame and control signals from an external processor. The timing controller 11 may render the grayscale values to correspond to a specification of the display device 10. In one embodiment, for example, the external processor may provide a red grayscale value, a green grayscale value, and a blue grayscale value for each unit dot or pixel. In an embodiment, where the pixel unit 15 has a PenTile structure, adjacent unit dots share pixels, the pixels may not correspond one-to-one to each grayscale value. In such an embodiment, rendering of the grayscale values is performed. When the pixels correspond one-to-one to each grayscale value, the rendering of the grayscale values may not be performed. The grayscale values rendered or not rendered may be provided to the data driver 12. In such an embodiment, the timing controller 11 may provide control signals suitable for each specification to the data driver 12, the scan driver 13, the emission driver 14, and the like to display an image of the frame.

The data driver 12 may generate data voltages to be provided to data lines DL1, DL2, DL3, DLj, and DLn based on the grayscale values and the control signals. In one embodiment, for example, the data driver 12 samples the grayscale values by using a clock signal and applies data voltages corresponding to the grayscale values to the data lines DL1 to DLn in units of pixel rows (for example, pixels connected to the same scan line). Here, n may be an integer greater than zero.

The scan driver 13 may receive a clock signal, a scan start signal, and the like from the timing controller 11 and generate scan signals to be provided to the scan lines SL1, SL2, SL3, SL(i−1), SLi, SL(k−1), SLk, and SLm. Here, i, k, and m may be integers greater than zero, k may be an integer larger than i, and m may be an integer larger than k.

The scan driver 13 may sequentially supply the scan signals having pulses of a turn-on level to the scan lines SL1 to SLm. The scan driver 13 may include scan stages including shift registers. The scan driver 13 may generate the scan signals by sequentially transmitting the scan start signal in the form of a pulse of a turn-on level to the next scan stage based on the clock signal.

The emission driver 14 may receive the clock signal, an emission stop signal, and the like from the timing controller 11 and generate emission signals to be provided to emission lines EL1, EL2, EL3, ELi, ELk, and ELo. Here, i and k may be an integer greater than zero, and o may be an integer greater than k. In one embodiment, for example, the emission driver 14 may sequentially provide emission signals having pulses of a turn-off level to the emission lines EL1 to ELo. In one embodiment, for example, each emission stage of the emission driver 14 may include a shift register and generate the emission signals by sequentially transmitting the emission stop signals in the form of a pulse of a turn-off level to the next emission stage based on the clock signal. In an alternative embodiment, the emission driver 14 may be omitted depending on a circuit configuration of pixels PX1 and PX2.

The pixel unit 15 includes the pixels PX1 and PX2. Each of the pixels PX1 and PX2 may be connected to a corresponding data line, a corresponding scan line, and a corresponding emission line. In an alternative embodiment, the emission driver 14 is omitted, and the pixels PX1 and PX2 may not be connected to the emission lines EL1 to ELo. In an embodiment, a scan input terminal of the first pixel PX1 may be connected to the i-th scan line SLi, and a data input terminal of the first pixel PX1 may be connected to the j-th data line DLj. In an embodiment, a scan input terminal of the second pixel PX2 may be connected to the k-th scan line SLk, and a data input terminal of the second pixel PX2 may be connected to the j-th data line DLj.

The pixel unit 15 may correspond to a display area of the display device 10. The pixel unit 15 may include a first area AR1 and a second area AR2 spaced apart from each other via a folding line FL as a boundary. In an alternative embodiment, a folding area may be defined between the first and the second areas AR1 and AR2. The display device 10 may be folded on the basis of the folding line FL or the folding area.

In an embodiment, the folding line FL may be physically defined. In one embodiment, for example, the display device 10 may further include a mechanical configuration such as a hinge, and the display device 10 may be configured to be folded or unfolded on the basis of the folding line FL. In such an embodiment, the folding line FL may be defined in a fixed position. In such an embodiment, the first area AR1 and the second area AR2 may be fixed areas. In an alternative embodiment, the display device 10 may have a flexible mount which covers a display panel. In such an embodiment, the folding line FL may be variable. In such an embodiment, the first area AR1 and the second area AR2 may be variable areas. In such an embodiment, the display device 10 may further include a pressure sensor, a bending sensor, a resistance sensor, and the like to detect the folding line FL.

FIG. 1 illustrates an embodiment where the first area AR1 and the second area AR2 are in contact with each other via the folding line FL as a boundary. In an alternative embodiment, the first area AR1 and the second area AR2 may be spaced apart from each other without being in contact with each other.

The first pixel PX1 may be located in the first area AR1. The second pixel PX2 may be located in the second area AR2. FIG. 1 illustrates an embodiment where the first pixel PX1 and the second pixel PX2 are connected to a same data line DLj for convenience of illustration and description. Alternatively, the first pixel PX1 and the second pixel PX2 may be connected to data lines different from each other.

Figure 2:
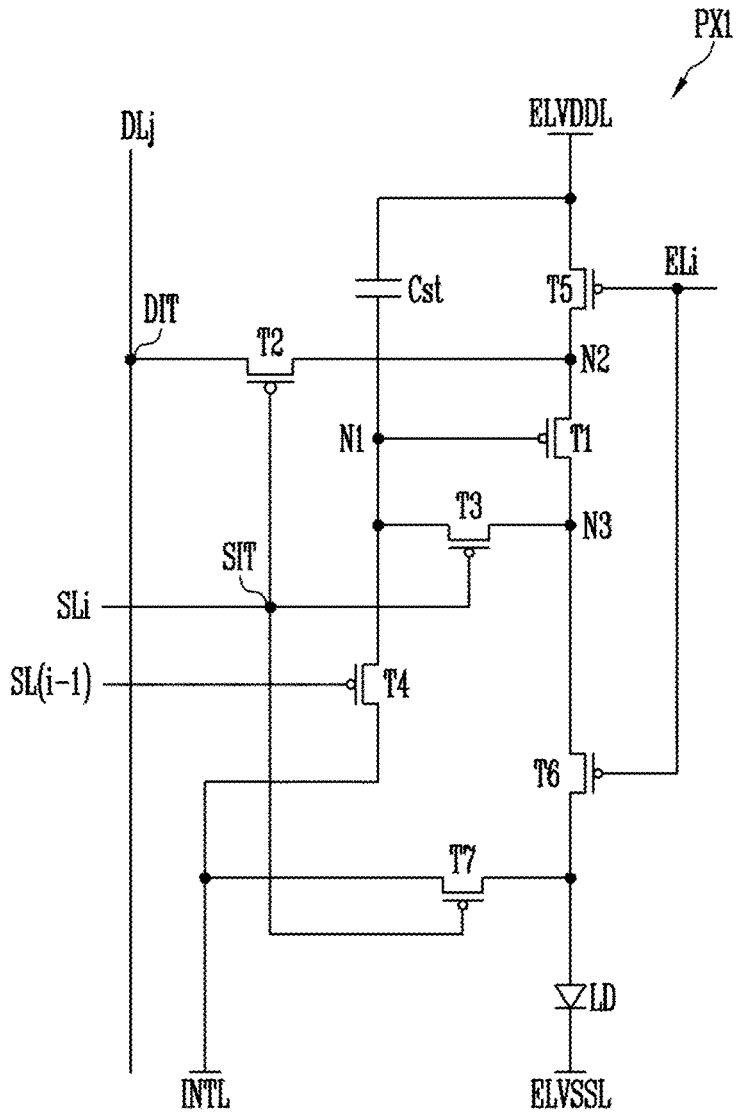
FIG. 2 is a circuit diagram illustrating a pixel according to an embodiment of the disclosure.

FIG. 2 is a circuit diagram illustrating the pixel according to an embodiment of the disclosure.

Referring to FIG. 2, in an embodiment, the first pixel PX1 includes transistors T1, T2, T3, T4, T5, T6, and T7, a storage capacitor Cst, and a light emitting diode LD. In an embodiment, the second pixel PX2 may have a same configuration as the first pixel PX1 except the connected scan lines SL(k−1) and SLk and the emission line Elk connected thereto. In an alternative embodiment, circuit configurations of the first pixel PX1 and the second pixel PX2 may be different from each other.

Hereinafter, an embodiment where each of the transistors T1, T2, T3, T4, T5, T6, and T7 is a P-type transistor will be described in detail. However, those skilled in the art will be able to design a circuit configured with an N-type transistor by changing a polarity of a voltage applied to a gate terminal thereof. Similarly, those skilled in the art will be able to design a circuit configured with a combination of the P-type transistor and the N-type transistor. The P-type transistor is a generic term for a transistor in which the amount of current to be conducted increases when a voltage difference between a gate electrode and a source electrode increases in a negative direction. The N-type transistor is a generic term for a transistor in which the amount of current to be conducted increases when the voltage difference between the gate electrode and the source electrode increases in a positive direction. The transistor may be configured in various forms such as a thin film transistor ("TFT"), a field effect transistor ("FET"), and a bipolar junction transistor ("BJT").

In an embodiment, a gate electrode of the first transistor T1 may be connected to a first node N1, a first electrode of the first transistor T1 may be connected to a second node N2, and a second electrode of the first transistor T1 may be connected to a third node N3. The first transistor T1 may be referred to as a driving transistor.

In an embodiment, a gate electrode of the second transistor T2 may be connected to the i-th scan line SLi, a first electrode of the second transistor T2 may be connected to the data line DLj, and a second electrode of the second transistor T2 may be connected to the second node N2. The second transistor T2 may be referred to as a scan transistor. The first electrode of the second transistor T2 may be the data input terminal DIT of the first pixel PX1. In such an embodiment, the gate electrode of the second transistor T2 may be the scan input terminal SIT of the first pixel PX1.

In an embodiment, a gate electrode of the third transistor T3 may be connected to the i-th scan line SLi, a first electrode of the third transistor T3 may be connected to the first node N1, and a second electrode of the third transistor T3 may be connected to a third node N3. The third transistor T3 may be referred to as a diode-connected transistor.

In an embodiment, a gate electrode of the fourth transistor T4 may be connected to the i-th scan line SL (i−1), a first electrode of the fourth transistor T4 may be connected to the first node N1, and a second electrode of the fourth transistor T4 may be connected to an initialization line INTL. In an alternative embodiment, the gate electrode of the fourth transistor T4 may be connected to another scan line. The fourth transistor T4 may be referred to as a gate initialization transistor.

In an embodiment, a gate electrode of the fifth transistor T5 may be connected to the i-th emission line ELi, a first electrode of the fifth transistor T5 may be connected to a first power supply line ELVDDL, and a second electrode of the fifth transistor T5 may be connected to the second node N2. The fifth transistor T5 may be referred to as an emission transistor. In an alternative embodiment, the gate electrode of the fifth transistor T5 may be connected to another emission line.

In an embodiment, a gate electrode of the sixth transistor T6 may be connected to the i-th emission line ELi, a first electrode of the sixth transistor T6 may be connected to the third node N3, and a second electrode of the sixth transistor T6 may be connected to an anode of the light emitting diode LD. The sixth transistor T6 may be referred to as an emission transistor. In an alternative embodiment, the gate electrode of the sixth transistor T6 may be connected to another emission line.

In an embodiment, a gate electrode of the seventh transistor T7 may be connected to the i-th scan line SLi, a first electrode of the seventh transistor T7 may be connected to the initialization line INTL, and a second electrode of the seventh transistor T7 may be connected to the anode of the light emitting diode LD. The seventh transistor T7 may be referred to as a light emitting diode initialization transistor. In an alternative embodiment, the gate electrode of the seventh transistor T7 may be connected to another scan line. In one embodiment, for example, the gate electrode of the seventh transistor T7 may be connected to an (i+1)-th scan line.

A first electrode of the storage capacitor Cst may be connected to the first power supply line ELVDDL, and a second electrode of the storage capacitor Cst may be connected to the first node N1.

The light emitting diode LD may have the anode connected to the second electrode of the sixth transistor T6 and a cathode connected to a second power supply line ELVSSL. The light emitting diode LD may be configured by an organic light emitting diode, an inorganic light emitting diode, a quantum dot light emitting diode, or the like.

A first power supply voltage may be applied to the first power supply line ELVDDL, a second power supply voltage may be applied to the second power supply line ELVSSL, and an initialization voltage may be applied to the initialization line INTL. In one embodiment, for example, the first power supply voltage may be greater than the second power supply voltage. In one embodiment, for example, the initialization voltage may be equal to or greater than the second power supply voltage. In one embodiment, for example, the initialization voltage may correspond to a lowest data voltage among available data voltages. In one embodiment, for example, the initialization voltage may be lower than the available data voltages.

Figure 3:
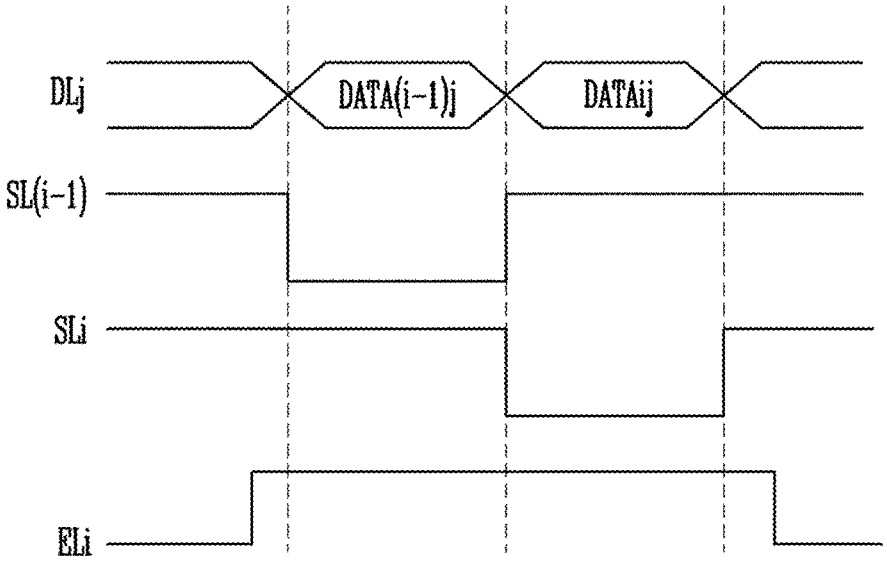
FIG. 3 is a diagram illustrating an embodiment of a driving method of the pixel of FIG. 2.

FIG. 3 is a diagram illustrating an embodiment of a driving method of the pixel of FIG. 2.

First, as shown in FIG. 3, a data voltage DATA(i−1)j for the (i−1)-th pixel is applied to the data line DLj, and a scan signal of a turn-on level (low level) is applied to the (i−1)-th scan line SL(i−1).

At this time, since the scan signal of a turn-off level (high level) is applied to the i-th scan line SLi, the second transistor T2 is turned off, and a data voltage DATA(i−1)j is thereby prevented from being applied to the first pixel PX1.

At this time, since the fourth transistor T4 is turned on, the first node N1 is connected to the initialization line INTL, and a voltage of the first node N1 is thereby initialized. Since the emission signal of a turn-off level is applied to the emission line ELi, the transistors T5 and T6 are turned off, and undesired emission of the light emitting diode LD due to an initialization voltage application process is thereby prevented.

Next, a data voltage DATAij for the i-th first pixel PX1 is applied to the data line DLj, and the scan signal of a turn-on level is applied to the i-th scan line SLi. Accordingly, the transistors T2, T1, and T3 are turned on, and the data line Dj and the first node N1 are thereby electrically connected to each other. Thus, a compensation voltage obtained by subtracting a threshold voltage of the first transistor T1 from the data voltage DATAij is applied to the second electrode (that is, the first node N1) of the storage capacitor Cst, and the storage capacitor Cst maintains a voltage corresponding to a difference between the first power supply voltage and the compensation voltage. This period may be referred to as a threshold voltage compensation period.

At this time, since the seventh transistor T7 is turned on, the anode of the light emitting diode LD is connected to the initialization line INTL, and the light emitting diode LD corresponds is initialized to the amount of charges corresponding to a voltage difference between the initialization voltage and the second power supply voltage.

Thereafter, the emission signal of a turn-on level is applied to the emission line ELi, and the transistors T5 and T6 may be thereby turned on. Thus, a driving current path is formed as a path of the first power supply line ELVDDL, the fifth transistor T5, the first transistor T1, the sixth transistor T6, the light emitting diode LD and the second power supply line ELVSSL.

The amount of driving currents flowing through the first and second electrodes of the first transistor T1 is adjusted based on a voltage maintained in the storage capacitor Cst. The light emitting diode LD emits light with a luminance corresponding to the amount of driving currents. The light emitting diode LD emits light until the emission signal of a turn-off level is applied to the emission line ELi.

In an embodiment, when a data voltage or an off voltage corresponding to a black grayscale value is applied to the first node N1, the first transistor T1 is turned off, and the first pixel PX1 may not emit light independently of a level of the emission signal. The black grayscale may be the smallest grayscale among grayscales that may be displayed by the first pixel PX1 or may correspond to one of grayscale ranges suitable for black representation.

Figure 4:
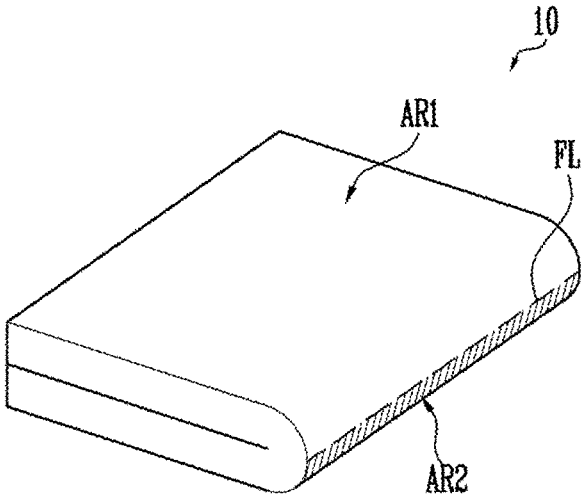
FIG. 4 is a diagram illustrating an embodiment of a driving method of the display device in a folded state.

FIG. 4 is a diagram illustrating an embodiment of a driving method of the display device in a folded state.

Referring to FIG. 4, an embodiment of the display device 10 including the first area AR1 and the second area AR2 spaced apart from each other by the folding line FL as a boundary may be folded on the basis of the folding line FL. In such an embodiment, the display device 10 may operate in a first mode when being in the folded state.

When the scan driver 13 applies the scan signal of a turn-on level to the first scan line SLi of the first area AR1, the data driver 12 may apply a data voltage corresponding to the grayscale value of the first pixel PX1 connected to the first scan line SLi to the data line DLj. Thus, the first area AR1 may display an image.

When the scan driver 13 applies the scan signal of a turn-on level to the second scan line SLk of the second area AR2, the data driver 12 may apply an off voltage corresponding to the black grayscale value to the data line DLj. Thus, the second area AR2 may be in a non-emission state in which no image is displayed.

In such an embodiment, when the off voltage is applied to the data line DLj by the data driver 12, the data line DLj may not be in a floating state because no voltage is applied to the data line DLj.

In a pixel circuit of FIG. 2, the first transistor T1 is a P-type transistor, for example, such that the off voltage may correspond to the highest voltage among the data voltages.

If the data driver 12 does not apply any voltage to the data line DLj, the data line DLj enters a floating state, an undefined voltage may be stored in the first node N1 of the second pixel PX2 when the scan driver 13 applies the scan signal of a turn-on level to the second scan line SLk. Accordingly, the second area AR2 may display an undefined image, which may be recognized by a user as a defect.

In an embodiment, the data driver 12 applies an off voltage corresponding to the black grayscale value to the data line DLj to ensure the non-emission state of the second area AR2 in the state of FIG. 4.

Figure 5:
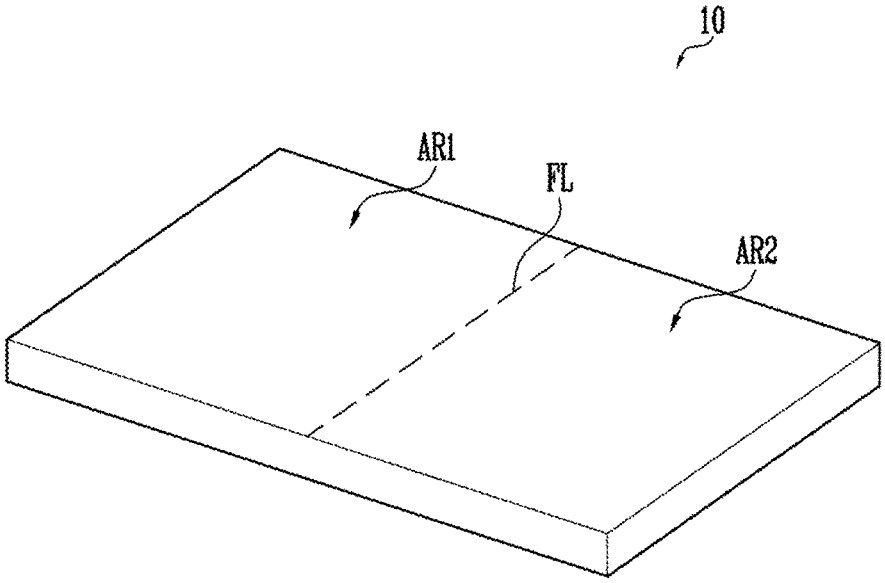
FIG. 5 is a diagram illustrating an embodiment of a driving method of the display device in an unfolded state.

FIG. 5 is a diagram illustrating an embodiment of the driving method of the display device in an unfolded state.

Referring to FIG. 5, in an embodiment, the display device 10 may be unfolded on the basis of the folding line FL. In such an embodiment, the display device 10 may operate in a second mode when being in the unfolded state.

When the scan driver 13 applies the scan signal of a turn-on level to the first scan line SLi, the data driver 12 may apply a data voltage corresponding to the grayscale value of the first pixel PX1 to the data line DLj. Thus, the first area AR1 may display an image.

When the scan driver 13 applies the scan signal of a turn-on level to the second scan line SLk, the data driver 12 may apply a data voltage corresponding to a grayscale value of the second pixel PX2 connected to the second scan line SLK to the data line Dj. Thus, the second area AR2 may display an image.

Figure 6:
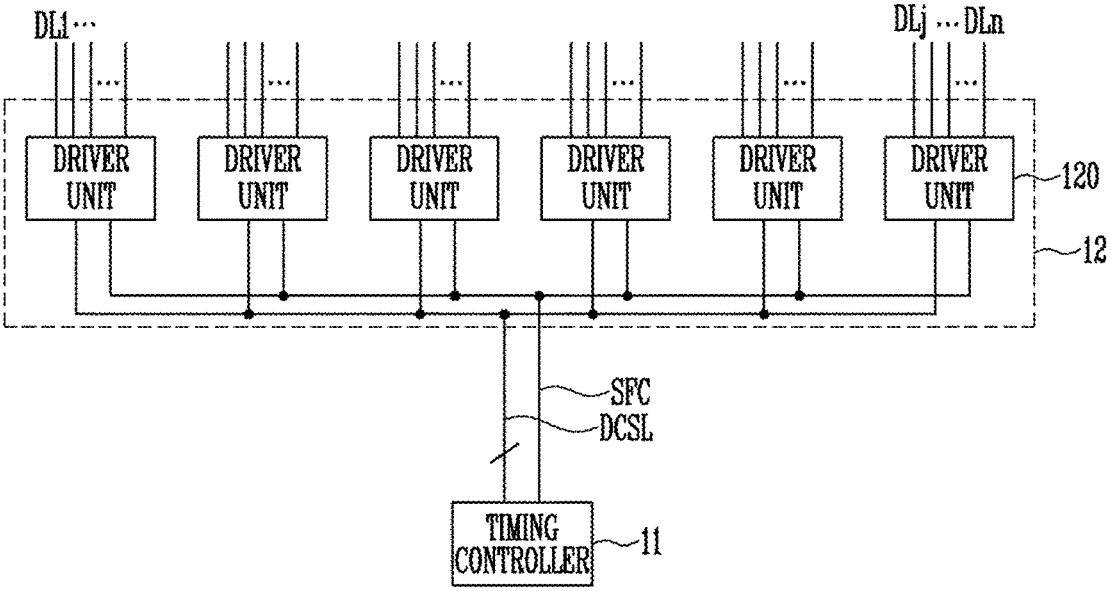
FIGS. 6 and 7 are diagrams illustrating a data driver according to an embodiment of the disclosure.
Figure 7:
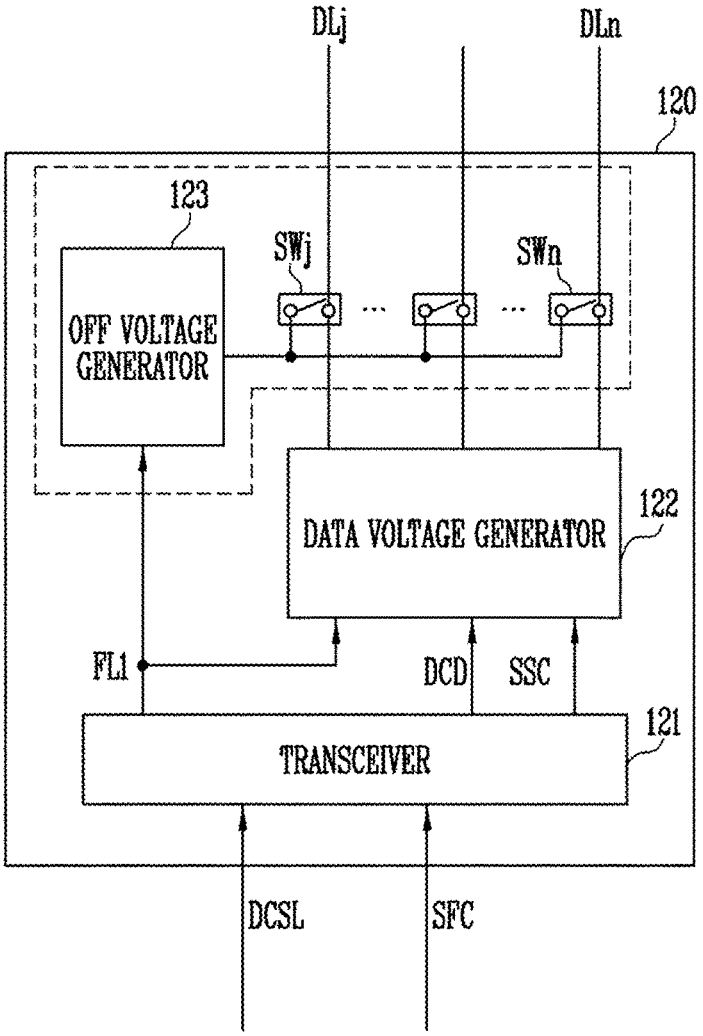

FIGS. 6 and 7 are diagrams illustrating the data driver according to an embodiment of the disclosure.

Referring to FIG. 6, an embodiment of the data driver 12 may include one or a plurality of driver units 120. In an embodiment where the display device 10 includes a single driver unit 120, the single driver unit 120 may define the data driver 12. In such an embodiment, all the data lines DL1 to DLn may be connected to the single driver unit 120. In an embodiment, where the display device 10 includes the plurality of driver units 120, the data lines DL1 to DLn may be grouped, and each data line group may be connected to a corresponding driver unit 120.

The driver unit 120 may use a same clock training line SFC as a common bus line. In one embodiment, for example, the timing controller 11 may simultaneously transmit a notification signal indicating that a clock training pattern is supplied to all the driver units 120 through the one clock training line SFC.

The driver unit 120 may be connected to the timing controller 11 through a dedicated clock data line DCSL. In one embodiment, for example, where the display device 10 includes the plurality of driver units 120, each of the driver units 120 may be connected to the timing controller 11 through each of a plurality of clock data lines DCSL.

In an embodiment, at least one clock data line DCSL of the driver unit 120 may be provided. In one embodiment, for example, when a bandwidth of the one clock data line DCSL is insufficient, a plurality of clock data lines DCSL may be connected to each driver unit 120 to replenish the bandwidth. In an embodiment, even when the clock data line DCSL is configured by a differential signal line to remove a common mode noise, each driver unit 120 may be connected to a plurality of clock data lines DCSL.

Referring to FIG. 7, an embodiment of the driver unit 120 may include a transceiver 121, a data voltage generator 122, an off voltage generator 123, and switches SWj to SWn.

The transceiver 121 may receive a clock data signal from the timing controller 11 through the clock data line DCSL. The transceiver 121 may receive a clock training signal from the timing controller 11 through the clock training line SFC.

The transceiver 121 may generate a clock signal based on the clock training signal and the clock data signal and sample a data signal DCD from the clock data signal based on the generated clock signal. The transceiver 121 may provide the sampled data signal DCD to the data voltage generator 122. In such an embodiment, the transceiver 121 may provide a source shift clock SSC to the data voltage generator 122.

In one embodiment, for example, the transceiver 121 may sequentially provide grayscale values of the pixels included in the data signal DCD to the data voltage generator 122 during an active data period. In such an embodiment, when a lock failure of the clock signal occurs during the active data period, the transceiver 121 may generate a first lock failure signal FL1 such that the off voltage is applied to the data line.

The active data period may be a supply period of the grayscale values configuring an image frame to be displayed by the pixel unit 15. A vertical blank period may be a transitional period between the active data period of a previous frame and the active data period of a current frame. Clock training, frame setting, and dummy data supply may be performed during the vertical blank period. Each frame period may include the active data period and the vertical blank period. Each period will be described below in greater detail with reference to FIG. 12.

The data voltage generator 122 may receive the data signal DCD, the source shift clock SSC and the first lock failure signal FL1 from the transceiver 121. The data voltage generator 122 may generate data voltages based on the source shift clock SSC, control signals included in the data signal DCD, and the grayscale values.

When the scan signal of a turn-on level is applied to the scan line, the data voltage generator 122 may apply the data voltages corresponding to the grayscale values of the pixels connected to the corresponding scan line to the data lines DLj to DLn. In one embodiment, for example, when the scan signal of a turn-on level is applied to the first scan line SLi, the data voltage generator 122 may apply the data voltage corresponding to the grayscale value of the first pixel PX1 to the data line DLj.

The off voltage generator 123 may generate an off voltage corresponding to the black grayscale value. Each of the switches SWj to SWn may have one terminal connected to the data lines DLj to DLn and another end connected to an output terminal of the off voltage generator 123.

The off voltage generator 123 and the switches SWj to SWn may selectively apply the off voltage to the data lines DLj to DLn based on the first lock failure signal FL1. In one embodiment, for example, when the first lock failure signal FL1 is generated, the switches SWj to SWn may connect the data lines DLj to DLn to the output terminal of the off voltage generator 123 (turn-on state). Thus, an off voltage may be applied to the data lines DLj to DLn. In one embodiment, for example, in a state where the first lock failure signal FL1 is not generated, the switches SWj to SWn electrically disconnect the data lines DLj to DLn from the output terminal of the off voltage generator 123 (turn-off state).

In an alternative embodiment, the driver unit 120 may not include the switches SWj to SWn. In one embodiment, for example, when the first lock failure signal FL1 is generated, the off voltage generator 123 may generate the off voltage, and when the first lock failure signal FL1 is not generated, the off voltage generator 123 may not generate the off voltage. Accordingly, in embodiments of the invention, the switches SWj to SWn may be optionally included.

According to an embodiment, in the first mode in which the display device 10 is in a folded state, when the scan signal of a turn-on level is applied to the second scan line SLk, the data voltage generator 122 may not output the data voltages.

In the first mode, when the scan signal of a turn-on level is applied to the second scan line SLk, the off voltage generator 123 may apply an off voltage corresponding to the black grayscale value to the data lines DLj to DLn. At this time, the switches SWj to SWn may be in a turn-on state.

Thus, in such an embodiment, voltages of the data lines DLj to DLn are prevented from being in an undefined state, and the second area AR2 may not emit light in the first mode. In such an embodiment, since the data voltage generator 122 does not drive buffer units for outputting the data voltages, power consumption may be reduced. Since the off voltage generator 123 generates only an off voltage of a single level corresponding to the black grayscale value, the off voltage generator 123 may be realized by only a single buffer unit, and thereby, power consumption is substantially reduced.

According to an alternative embodiment, in the first mode, when the scan signal of a turn-on level is applied to the second scan line SLk, the data voltage generator 122 may apply a data voltage corresponding to a black grayscale value to the data lines DLj to DLn. In such an embodiment, the data voltage generator 122 may apply the data voltage corresponding to the black grayscale value to the data lines DLj to DLn during a predetermined delay period in the first mode. Start time of the delay period may be time when the data voltage generator 122 receives the first lock failure signal FL1. The data voltage generator 122 may not output the data voltages after the delay period.

In such an embodiment, in the first mode, the data voltage generator 122 and the off voltage generator 123 may simultaneously apply the data voltages and the off voltages to the data lines DLj to DLn, respectively during the delay period. During the delay period, the second pixel PX2 may not emit light stably in the transition period until the data voltage generator 122 ends the output of the data voltages. That is, since neither the data voltage generator 122 nor the off voltage generator 123 generates a voltage during the transition period, it is possible to more reliably prevent a phenomenon in which a pixel row including the second pixel PX2 emits light from occurring.

In the second mode in which the pixel unit 15 is in the unfolded state, when the scan signal of a turn-on level is applied to the second scan line SLk, the data voltage generator 122 may apply a data voltage corresponding to a grayscale value to the data line DLj.

In the second mode, when the scan signal of a turn-on level is applied to the second scan line SLk, the off voltage generator 123 may not apply the off voltage to the data line DLj. In one embodiment, for example, in the second mode, the switches SWj to SWn may be turned off. In one embodiment, for example, in the second mode, the switches SWj to SWn may be continuously turned off independently of the first lock failure signal FL1.

Thus, in the second mode, the first area AR1 and the second area AR2 may display an image.

Figure 8:
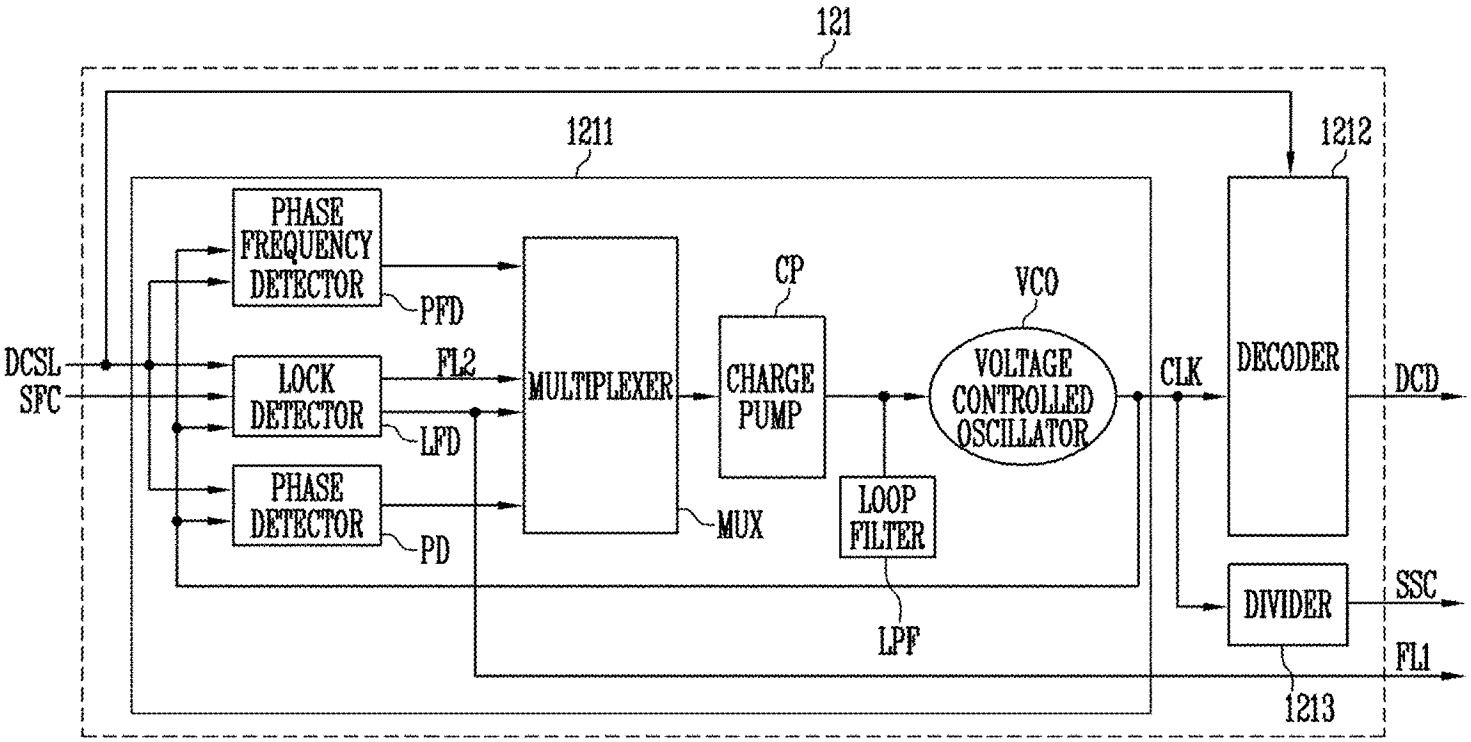
FIG. 8 is a diagram illustrating a transceiver according to an embodiment of the disclosure.

FIG. 8 is a diagram illustrating the transceiver according to an embodiment of the disclosure.

Referring to FIG. 8, an embodiment of the transceiver 121 may include a clock data recovery circuit 1211, a decoder 1212, and a divider 1213.

The clock data recovery circuit 1211 may generate a clock signal CLK based on the clock training signal provided from the clock training line SFC and the clock data signal provided from the clock data line DCSL.

The clock data recovery circuit 1211 may generate the first lock failure signal FL1 when a lock failure of the clock signal CLK occurs during the active data period.

The decoder 1212 may sample the data signal DCD from the clock data signal based on the clock signal CLK.

The divider 1213 may generate the frequency-shifted source shift clock SSC based on the clock signal CLK.

In such an embodiment, the clock data recovery circuit 1211 may include a phase frequency detector PFD, a lock detector LFD, a phase detector PD, a multiplexer MUX, a charge pump CP, a loop filter LPF, and a voltage controlled oscillator VCO.

The timing controller 11 may apply the clock training signal of a first level (for example, a low level) to the clock training line SFC in at least a part of the vertical blank period and may apply the clock training signal of a second level (for example, a high level) to the clock training line SFC in the remaining period of the vertical blank period and the active data period. In such an embodiment, when the clock training signal of the first level is applied, the timing controller 11 may apply a clock training pattern CTP (see FIG. 12) to the clock data line DCSL.

The voltage controlled oscillator VCO may generate the clock signal CLK.

The phase frequency detector PFD may generate a first up signal or a first down signal by comparing the clock signal CLK with the clock training pattern CTP.

The lock detector LFD may detect whether or not the clock signal CLK is locked by comparing the clock signal CLK with the clock training pattern CTP while receiving the clock training signal of the first level. In one embodiment, for example, when the lock of the clock signal CLK fails while receiving the clock training signal of the first level, the lock detector LFD may provide a second lock failure signal FL2 to the multiplexer MUX.

When receiving the second lock failure signal FL2, the multiplexer MUX may allow the first up signal or the first down signal of the phase frequency detector PFD to pass therethrough. At this time, the multiplexer MUX may not allow an output signal of the phase detector PD to pass therethrough. That is, during the clock training period, the phase frequency detector PFD may contribute mainly to the generation of the clock signal CLK.

The charge pump CP may increase a charge supply amount in response to the first up signal output from the multiplexer MUX or reduce the charge supply amount in response to the first down signal.

The loop filter LPF may include, for example, a capacitor. The loop filter LPF generates a control voltage to the ground at one end of the capacitor based on the charge supply amount of the charge pump CP. The control voltage may be applied to the voltage controlled oscillator VCO, and the voltage controlled oscillator VCO may generate the clock signal CLK, a frequency or phase of which is controlled based on the control voltage.

When the lock of the clock signal CLK succeeds after such a series of processes, the lock detector LFD may provide a lock success signal to the multiplexer MUX. In one embodiment, for example, the lock success signal to and the second lock failure signal FL2 may be voltage signals having different voltage levels from each other and provided to a same signal line.

When receiving the lock success signal, the multiplexer MUX may allow the output signal of the phase detector PD to pass therethrough and may not allow the output signal of the phase frequency detector PFD to pass therethrough. That is, during the active data period, the phase detector PD may contribute mainly to maintenance of the clock signal CLK.

The phase detector PD may generate a second up signal or a second down signal by comparing the clock signal CLK with the clock data signal. At this time, the clock data signal may include data (for example, a transition bit AD) for maintaining the clock signal CLK at regular time intervals (see FIGS. 12 and 13).

The charge pump CP may increase the charge supply amount in response to the second up signal output from the multiplexer MUX or may reduce the charge supply amount in response to the second down signal. Accordingly, operations of the loop filter LPF and the voltage controlled oscillator VCO are the same as those described above.

Through such a series of processes, a phase of the clock signal CLK may be maintained during the active data period.

In one embodiment, for example, when a lock failure of the clock signal CLK occurs while the clock training signal of the second level is applied, the lock detector LFD may generate the first lock failure signal FL1.

When the first lock failure signal FL1 is generated, the multiplexer MUX may not allow the output signals of the phase detector PD and the phase frequency detector PFD to pass therethrough.

The lock detector LFD continues to supply the first lock failure signal FL1 while the clock training signal of the second level is applied, and when the clock training signal of the first level is received, the lock detector LFD may stop supplying the first lock failure signal FL1.

Figure 11:
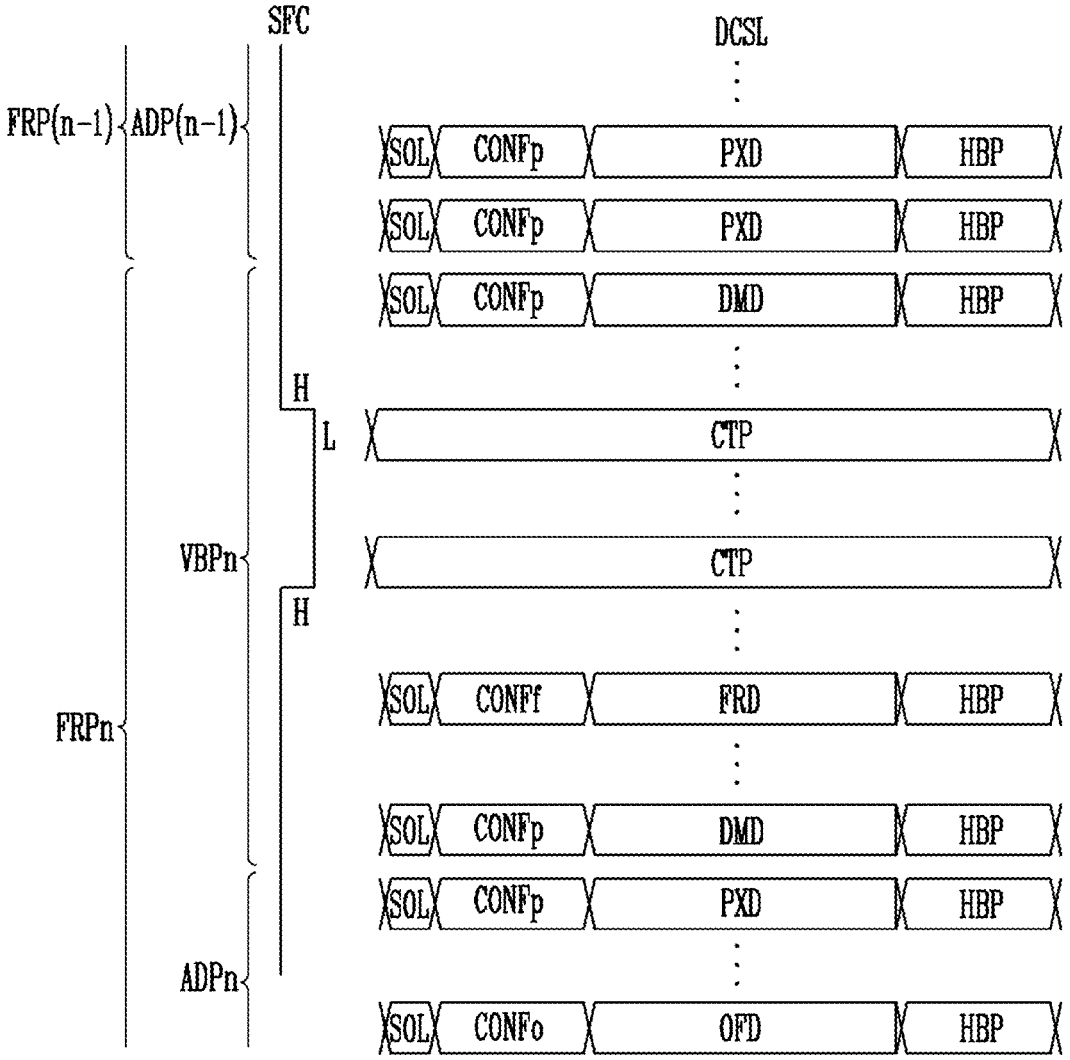
FIGS. 11 to 14 are diagrams illustrating signals provided by a timing controller according to an embodiment of the disclosure.

As will be described below with reference to FIG. 11, the lock failure of the clock signal CLK during the active data period may occur. Since a frequency and a phase of the clock signal CLK are desired to be maintained even at this time, the multiplexer MUX may not allow the output signals of the phase detector PD and the phase frequency detector PFD to pass therethrough. If the multiplexer MUX allows the output signals of the phase detector PD or the phase frequency detector PFD to pass therethrough, the frequency of the clock signal CLK is gradually lowered, and the clock signal CLK may not normally operate.

In one embodiment, for example, when the lock failure of the clock signal CLK occurs during the active data period, the lock detector LFD may generate the first lock failure signal FL1. In one embodiment, for example, when the lock failure of the clock signal CLK occurs during the supply period of the scan signals of a turn-on level, the lock detector LFD may generate the first lock failure signal FL1.

Figure 9:
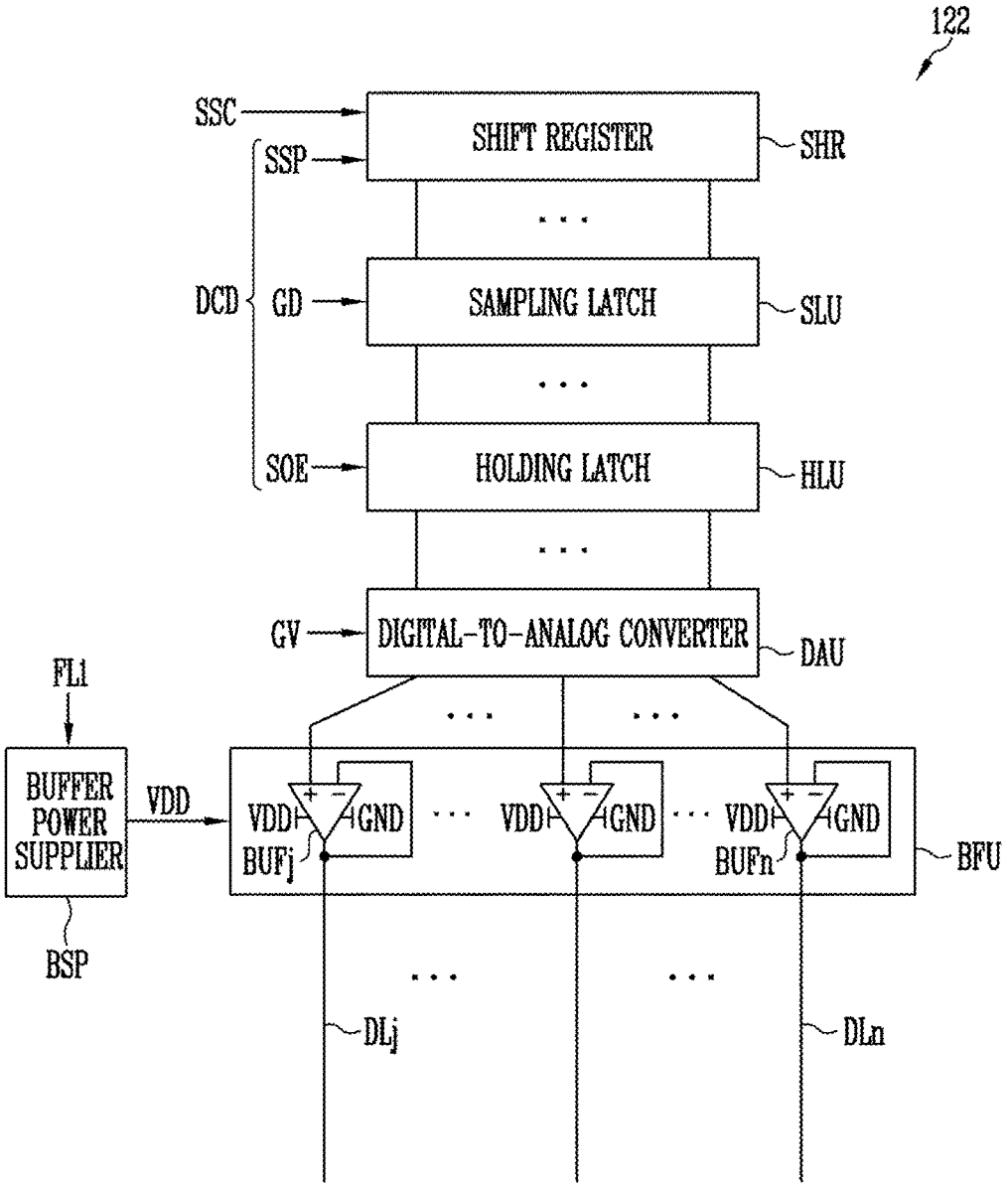
FIG. 9 is a diagram illustrating a data voltage generator according to an embodiment of the disclosure.

FIG. 9 is a diagram illustrating the data voltage generator according to an embodiment of the disclosure.

Referring to FIG. 9, an embodiment of the data voltage generator 122 may include a shift register SHR, a sampling latch SLU, a holding latch HLU, a digital-to-analog converter DAU, an output buffer BFU, and a buffer power supplier BSP.

The data signal DCD received from the transceiver 121 may include a source start pulse SSP, grayscale values GD, a source output enable signal SOE or the like.

The shift register SHR may sequentially generate sampling signals while shifting the source start pulse SSP every one period of the source shift clock SSC. The number of the sampling signals may correspond to the number of the data lines DLj to DLn. In one embodiment, for example, the number of the sampling signals may be equal to the number of the data lines DLj to DLn. In an embodiment, where the display device 10 further includes a demultiplexer between the data driver 12 and the data lines DLj to DLn, for example, the number of the sampling signals may be less than the number of the data lines DLj to DLn. For convenience of description, an embodiment where no demultiplexer is between the data driver 12 and the data lines DLj to DLn will hereinafter be described in detail, but not being limited thereto.

In an embodiment, the sampling latch SLU may include a plurality of sampling latch units, the number of which corresponds to the number of the data lines DLj to DLn, and may sequentially receive the grayscale values GD of an image frame from the timing controller 11. The sampling latch SLU may store the grayscale values GD sequentially provided from the timing controller 11 in corresponding sampling latch units thereof in response to the sampling signals sequentially supplied from the shift register SHR.

The holding latch HLU may include a plurality of holding latch units, the number of which corresponds to the number of the data lines DLj to DLn. The holding latch unit HLU may store the grayscale values GD stored in the sampling latch units in corresponding holding latch units thereof when the source output enable signal SOE is input.

The digital-to-analog converter DAU may include a plurality of digital-to-analog conversion units, the number of which corresponds to the number of the data lines DLj to DLn. In one embodiment, for example, the number of the digital-to-analog conversion units may be equal to the number of the data lines DLj to DLn. Each of the digital-to-analog conversion units may apply a grayscale voltage GV corresponding to the grayscale value GD stored in a corresponding holding latch to a corresponding data line.

The grayscale voltage GV may be provided from a grayscale voltage generator (not illustrated). The grayscale voltage generator may include a red grayscale voltage generator, a green grayscale voltage generator, and a blue grayscale voltage generator. At this time, the grayscale voltage GV may be set in a way such that a luminance corresponding to each grayscale is in a gamma curve.

The output buffer BFU may include buffer units BUFj to BUFn. In one embodiment, for example, each of the buffer units BUFj to BUFn may be an operational amplifier. Each of the buffer units BUFj to BUFn may be configured in the form of a voltage follower to apply an output of the digital-analog conversion unit to the corresponding data line. In one embodiment, for example, an inverting terminal of each of the buffer units BUFj to BUFn may be connected to an output terminal thereof, and a non-inverting terminal thereof may be connected to an output terminal of the digital-analog conversion unit. Outputs of the buffer units BUFj to BUFn may be data voltages.

In one embodiment, for example, the j-th buffer unit BUFj may have an output terminal connected to the j-th data line DLj and may receive a buffer power voltage VDD and a ground power supply voltage GND. The buffer power voltage VDD may determine an upper limit of an output voltage (that is, a data voltage) of the buffer unit BUFj. In such an embodiment, the ground power supply voltage GND may determine a lower limit of the output voltage of the buffer unit BUFj. Voltages other than the buffer power voltage VDD and the ground power supply voltage GND may be further applied to the buffer unit BUFj depending on a configuration thereof. Such other voltages may be control voltages that determine a slew rate of the buffer unit BUFj. The control voltages differ from the buffer power voltage VDD in that the control voltages are not voltages which determine the upper or lower limit of the output voltage of the buffer unit BUFj.

The buffer power supplier BSP may provide the buffer power voltage VDD to the buffer units BUFj to BUFn. In one embodiment, for example, the buffer power supplier BSP may stop the supply of the buffer power voltage VDD when the first lock failure signal FL1 is generated. Thus, power consumption of the output buffer BFU may be reduced.

In an embodiment, the buffer power supplier BSP may stop the supply of the buffer power voltage VDD after a predetermined delay period when the first lock failure signal FL1 is generated.

Figure 10:
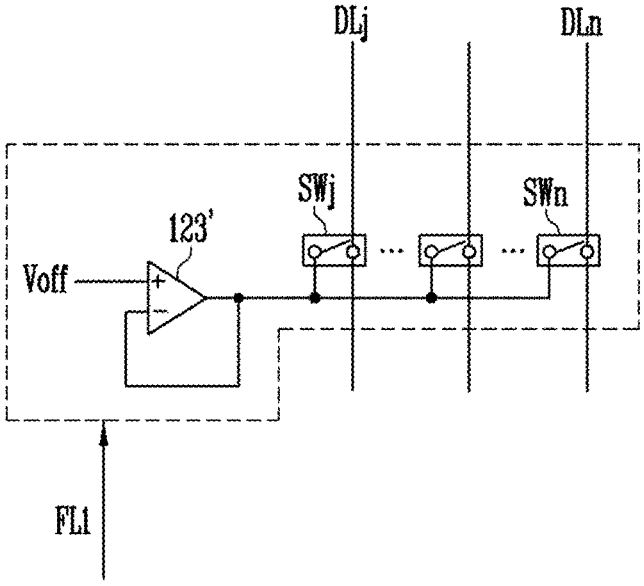
FIG. 10 is a diagram illustrating an off voltage generator according to an embodiment of the disclosure.

FIG. 10 is a diagram illustrating the off voltage generator according to an embodiment of the disclosure.

In FIG. 10, an embodiment in which the off voltage generator 123 of FIG. 7 is configured as a buffer unit 123' is illustrated.

The buffer unit 123' may include an operational amplifier. The buffer unit 123' may be configured in the form of a voltage follower to apply an off voltage Voff to the data lines DLj to DLn. In one embodiment, for example, an inverting terminal of the buffer unit 123' may be connected to an output terminal thereof, and a non-inverting terminal may receive the off voltage Voff.

FIGS. 11 to 14 are diagrams illustrating signals provided by the timing controller according to an embodiment of the disclosure.

A frame period for each image frame may include a vertical blank period and an active data period. In one embodiment, for example, an n-th frame period FRPn may include an n-th vertical blank period VBPn and an n-th active data period ADPn, and an (n−1)-th frame period FRP(n−1) may include an (n−1)-th vertical black period (not shown) and an (n−1)-th active data period ADP(n−1).

The active data periods ADP(n−1) and ADPn may be supply periods of grayscale values of the image frame to be displayed by the pixel unit 15. The grayscale values may be included in pixel data PXD.

The vertical blank period VBPn may be between the active data period ADP(n−1) of a previous frame and the active data period ADPn of a current frame. Clock training, frame setting, and dummy data supply may be performed during the vertical blank period VBPn. During the vertical blank period VPBn, the vertical blank period VBPn may sequentially include a supply period of dummy data DMD, a supply period of the clock training pattern CTP, a supply period of frame data FRD, and a supply period of the dummy data DMD.

The timing controller 11 may inform the data driver 12 that a signal of a first level (for example, a low level L) is applied to the clock training line SFC during the vertical blank period VBPn, such that the clock training pattern CTP is supplied to the clock data line DCSL. When the clock training pattern CTP is not supplied, the timing controller 11 may apply a signal of a second level (for example, a high level H) to the clock training line SFC.

Figure 12:
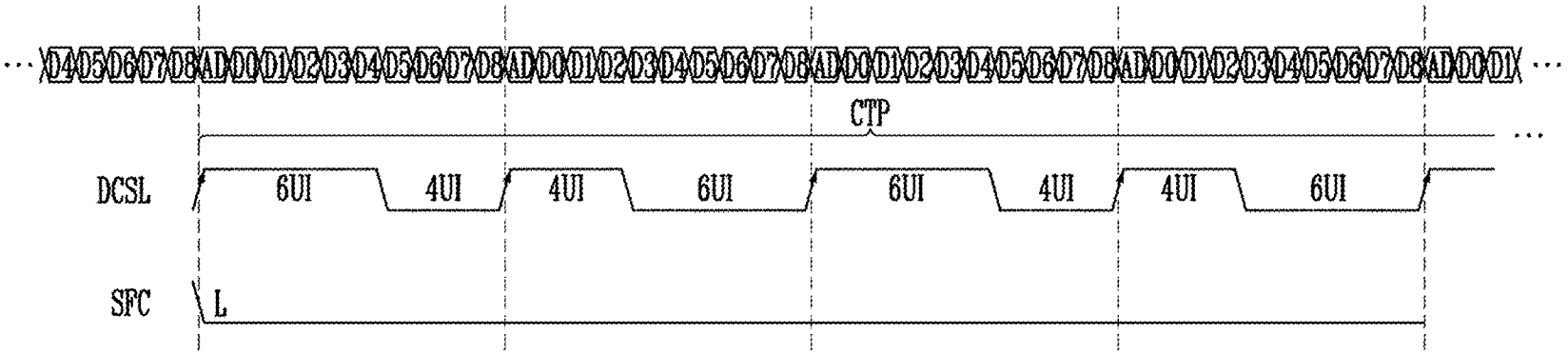

In FIG. 12, an embodiment of the clock training pattern CTP is illustrated. In one embodiment, for example, in the clock training pattern CTP, 10 bits AD, D0, D1, D2, D3, D4, D5, D6, D7, and D8 may configure unit data. A period in which the unit data is supplied to the clock data line DCSL may be referred to as one cycle. Each unit data repeats a high-level to low-level with a ratio of 6 to 4 (6UI/4UI) or 4 to 6 (4UI/6UI). The clock training pattern CTP may be variously modified.

Figure 13:
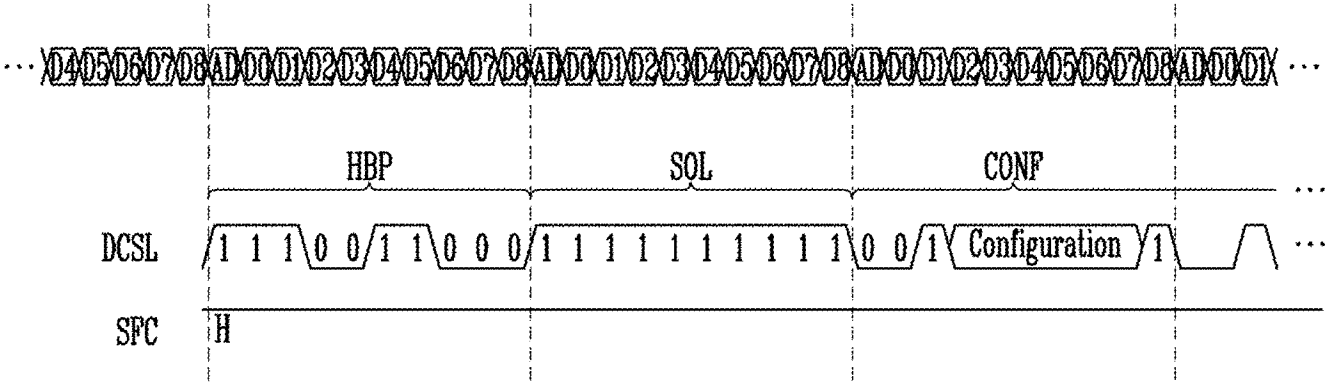

In FIG. 13, an embodiment of the data control signals HBP, SOL, and CONF are illustrated. In one embodiment, for example, in the data control signals HBP, SOL, and CONF, 10 bits AD, D0, D1, D2, D3, D4, D5, D6, D7, and D8 may configure unit data. Each unit data includes a transition bit AD. Although the transition may be variously modified, the transition bit AD may be set to be different from a previous bit. The transition bit AD may be set to be different in level from subsequent bits.

The horizontal blank period signal HBP may inform the driver unit 120 that a pixel row corresponding to the pixel data PXD (for example, pixels connected to the same scan line) is changed. In an embodiment, the horizontal blank period signal HBP is configured as 1110011000, for example, but not being limited thereto.

The line start signal SOL may inform the driver unit 200 that a supply of the signal for the changed pixel row starts. In an embodiment, a unit data string of the line start signal SOL may be configured as 1111111111, for example, but not being limited thereto.

The setting signal CONF may include an operation option of the driver unit 120. In one embodiment, for example, a setting signal CONFp may indicate that subsequent data is the pixel data PXD or the dummy data DMD. In one embodiment, for example, a setting signal CONFf may indicate that the subsequent data is the frame data FRD.

In such an embodiment, the timing controller 11 may cause a lock failure of the clock signal CLK. In one embodiment, for example, the timing controller 11 may cause the lock failure by not transmitting data (for example, the transition bit AD) for maintaining the clock signal CLK among the clock data signals. In one embodiment, for example, the timing controller 11 may cause the lock failure by maintaining a voltage level of the clock data signal for a predetermined period or more.

In one embodiment, for example, unlike other setting signals CONFp and CONFf, the setting signal CONFo may not include the transition bit AD for a certain period. The certain period may be two cycles (corresponding to two pieces of unit data) or more. In one alternative embodiment, for example, the certain period may correspond to four cycles (corresponding to four pieces of unit data).

Figure 14:
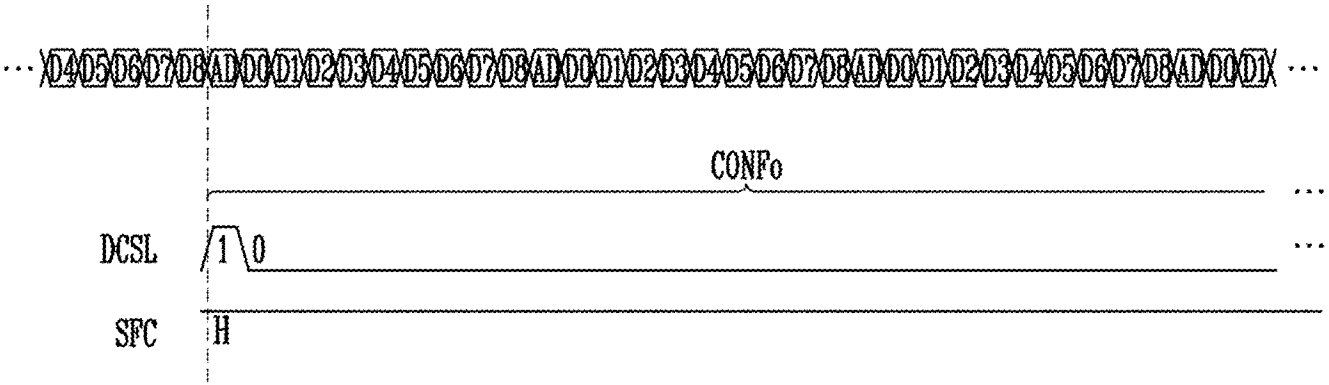

In one embodiment, for example, unlike other setting signals CONFp and CONFf, the setting signal CONFo may cause the lock failure by maintaining a voltage level of a clock data signal for a certain period or more. FIG. 14 illustrates an embodiment where the setting signal CONFo maintains a low level for a certain period. Alternatively, the setting signal CONFo may maintain a high level for a certain period. The certain period may be two or more cycles. In one embodiment, for example, the certain period may correspond to four cycles.

According to embodiments, as described above, when the timing controller 11 transmits the setting signal CONFo to the clock data line DCSL, the transition bit AD does not exist for a certain period, such that the phase detector PD does not normally operate. Thus, locking the clock signal CLK may fail, and the lock detector LFD may generate the first lock failure signal FL1.

Although not illustrated, the pixel data PXD may represents a grayscale value of a pixel to which remaining bits D0, D1, D2, D3, D4, D5, D6, D7, and D8 except the transition bit AD of the unit data are corresponding. A configuration of the pixel data PXD may be variously modified.

Off data OFD may include black grayscale values. Accordingly, the data voltage generator 122 may apply data voltages corresponding to the black grayscale values to the data lines during the above-described delay period.

The timing controller 11 may not transmit any signal to the data driver 12 or transmit only a minimum signal after the off data OFD is transmitted. Thus, power consumption of a transmitter of the timing controller 11 may be reduced.

The data driver 12 may not receive any signal from the timing controller 11 or receive only a minimum signal after the off data OFD is received. In one embodiment, for example, the transceiver 121 may not operate. Thus, power consumption of the data driver 12 may be reduced.

According to embodiment of the disclosure, the timing controller 11 may include first mode information, in the frame data FRD, indicating that the corresponding image frame is to operate in a first mode (folding mode). Accordingly, the timing controller 11 may inform the driver unit 120 that the first lock failure signal FL1 is not a simple malfunction but an intended lock failure. Thus, in an embodiment where the driver unit 120 includes a recovery function against the malfunction, the recovery function may not be performed in a case of the intended lock failure.

In an embodiment, as shown in FIG. 8, the lock failure may occur after the clock training pattern CTP is transmitted and before the frame data FRD is transmitted. Although the lock failure is not an intended lock failure, the lock detector LFD of FIG. 8 may generate the first lock failure signal FL1. When the first mode information included in the frame data FRD, the driver unit 120 may exclude the first lock failure signal FL1 generated after the clock training pattern CTP is transmitted and before the frame data FRD is transmitted, thereby effectively recognizing that the malfunction occurs.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a first pixel connected to a first scan line and a data line;

a second pixel connected to a second scan line and the data line; and a data driver connected to the data line, wherein the data driver includes:

a data voltage generator which applies a data voltage corresponding to a grayscale value of the first pixel to the data line when a scan signal of a turn-on level is applied to the first scan line;

an off voltage generator which applies an off voltage corresponding to a black grayscale value to the data line when a scan signal of a turn-on level is applied to the second scan line, in a first mode, and a transceiver which sequentially provides grayscale values to the data voltage generator during an active data period, the transceiver generates a lock failure signal such that the off voltage is applied to the data line when a lock failure of a clock signal occurs during the active data period.

2. The display device according to claim 1, further comprising:

a pixel unit including a first area and a second area spaced apart from each other by a folding line as a boundary, wherein the first pixel is in the first area, wherein the second pixel is in the second area, and wherein the pixel unit is folded on a basis of the folding line in the first mode.

3. The display device according to claim 2, wherein, in a second mode in which the pixel unit is in an unfolded state, the data voltage generator applies a data voltage corresponding to a grayscale value of the second pixel to the data line when a scan signal of a turn-on level is applied to the second scan line.

4. The display device according to claim 3, wherein, in the second mode, the off voltage generator does not apply the off voltage to the data line when the scan signal of the turn-on level is applied to the second scan line.

5. The display device according to claim 1, further comprising:

a switch including a terminal connected to the data line and another terminal connected to an output terminal of the off voltage generator, wherein the switch connects the data line to the output terminal of the off voltage generator when the lock failure signal is generated.

6. The display device according to claim 1, wherein the data voltage generator includes a buffer unit which generates the data voltage, and a buffer power supplier which supplies a buffer power voltage to the buffer unit, and the buffer power supplier stops supplying the buffer power voltage when the lock failure signal is generated.

7. The display device according to claim 6, wherein the buffer power supplier stops supplying the buffer power voltage after a predetermined delay period when the lock failure of the clock signal occurs.

8. The display device according to claim 7, wherein the data voltage generator applies a data voltage corresponding to the black grayscale value to the data line during the delay period.

9. The display device according to claim 1, wherein the data voltage generator applies a data voltage corresponding to the black grayscale value to the data line when the scan signal of the turn-on level is applied to the second scan line, in the first mode.

10. The display device according to claim 1, further comprising:

a timing controller which transmits a clock data signal to the data driver;

wherein the timing controller causes the lock failure of the clock signal by not transmitting data for maintaining the clock signal in the clock data signals.

11. The display device according to claim 1, further comprising:

a timing controller which transmits a clock data signal to the data driver;

wherein the timing controller causes the lock failure of the clock signal by maintaining a voltage level of the clock data signal for a predetermined period.

12. The display device according to claim 1, wherein the transceiver includes a phase detector which operates during the active data period, and a charge pump which determines a charge supply amount based on an output of the phase detector, and the charge pump is electrically isolated from the phase detector when the lock failure of the clock signal occurs during the active data period.

13. A driving method of a display device, the method comprising:

folding the display device on a basis of a folding line, wherein the display device includes a first area and a second area spaced apart from each other by the folding line as a boundary;

when the display device is in a folded state, applying a data voltage corresponding to a grayscale value of a first pixel connected to a first scan line to a data line when a scan signal of a turn-on level is applied to the first scan line, wherein the first pixel is connected to the data line, and the first pixel and the first scan line are in the first area;

when the display device is in the folded state, applying an off voltage corresponding to a black grayscale value to the data line when the scan signal of the turn-on level is applied to a second scan line connected to a second pixel, wherein the second pixel is connected to the data line, and the second pixel and the second scan line are in the second area; and when the display device is in the folded state and a lock failure of a clock signal occurs during a supply period of the scan signals of the turn-on level, the off voltage is applied to the data line.

14. The driving method of a display device according to claim 13, further comprising:

unfolding the display device on a basis of the folding line;

when the display device is in an unfolded state, applying a data voltage corresponding to a grayscale value of the first pixel to the data line when a scan signal of a turn-on level is applied to the first scan line; and when the display device is in the unfolded state, applying a data voltage corresponding to a grayscale value of the second pixel to the data line when the scan signal of the turn-on level is applied to the second scan line.

15. The driving method of a display device according to claim 13, further comprising:

when the lock failure of the clock signal occurs, stopping supplying a buffer power voltage to a buffer unit which generates the data voltage.

16. The driving method of a display device according to claim 15, wherein, when the lock failure of the clock signal occurs, supplying the buffer power voltage is stopped after a predetermined delay period.

17. The driving method of a display device according to claim 16, further comprising:

applying a data voltage corresponding to the black grayscale value to the data line during the delay period.

18. The driving method of a display device according to claim 17, wherein a period in which the data voltage corresponding to the black grayscale value is applied to the data line partially overlaps a period in which the off voltage is applied to the data line.

* * * * *